US007284999B1

(12) United States Patent
Ju

(10) Patent No.: US 7,284,999 B1
(45) Date of Patent: Oct. 23, 2007

(54) ELECTRICAL CONNECTOR

(75) Inventor: Ted Ju, Keelung (TW)

(73) Assignee: Lotes Co., Ltd., Keelung (TW)

( * ) Notice: Subject to any disclaimer, the term of this patent is extended or adjusted under 35 U.S.C. 154(b) by 0 days.

(21) Appl. No.: 11/594,203

(22) Filed: Nov. 8, 2006

(51) Int. Cl.
*H01R 29/00* (2006.01)

(52) U.S. Cl. ..... 439/188

(58) Field of Classification Search ..... 439/188, 439/668–669, 944, 637, 74, 79
See application file for complete search history.

(56) References Cited

U.S. PATENT DOCUMENTS 6,296,492 B1 * 10/2001 Fujimoto et al. ..... 439/63
6,368,156 B1 * 4/2002 Lin ..... 439/668
6,488,513 B1 12/2002 Neidich et al.
6,908,343 B1 * 6/2005 Hu ..... 439/668
6,988,901 B2 * 1/2006 Ribeau et al. ..... 439/79
6,988,913 B2 * 1/2006 Zhang ..... 439/637

* cited by examiner

*Primary Examiner*—J. F. Duverne
(74) *Attorney, Agent, or Firm*—Rosenberg, Klein & Lee

(57) ABSTRACT

An electrical connector comprises an insulating body, a plurality of conducting terminals, and a plurality of deformed terminals. The insulating body has a plurality of receiving notches, the conducting terminals are received in the receiving notches respectively. Each conducting terminal has a body and a contacting portion which extends outwardly from the body. The deformed terminals are installed in the conducting terminals respectively, and each conducting terminal is connected to each deformed terminal so as to deform the shape of the conducting terminal. The electrical connector of the present invention makes the connection with the conducting terminal steady and ensures that the electrical connection between the mating electrical components is more steady via the deformed terminals which are assembled in a crossed manner with the conducting terminals respectively.

7 Claims, 5 Drawing Sheets

ELECTRICAL CONNECTOR

BACKGROUND OF THE INVENTION

1. Field of the Invention

The present invention relates generally to an electrical connector and more particularly to an electrical connector that is applied to the connection between a planar lattice array chip module and a circuit board. The electrical connector of the present invention ensures the electrical connection between two mating electrical components is more stable.

2. Description of Related Art

Presently, an electrical connector is used for connecting a planar lattice array chip module to a circuit board when an electrical connector is included in an electrical connector terminal.

U.S. Pat. No. 6,488,513 discloses an electrical connector having a high arrangement compressed to contact the mating electrical component. The electrical connector includes an insulating body and a plurality of electrical connector terminals. The electrical connector terminal is roughly C-shaped and the electrical connector terminal includes an upper elastic arm, a lower elastic arm, and a body portion. Both the upper and the lower elastic arm extend from the upper end and the lower end of the body portion. The lower elastic arm is roughly horizontal-shaped, and the end of the lower elastic arm compresses to contact the metal pad of the electrical component (such as the circuit board).

However, the drawback of the current technology is that the fatigue strength of the electrical connector terminal is poor. The elasticity of the electrical connector terminal fades due to long periods of compression, and this in turn affects the electrical connection between the two mating electrical components.

SUMMARY OF THE INVENTION

The primary object of the present invention is to provide an electrical connector which ensures that the electrical connection between the two mating electrical components is more stable.

For achieving the above object, the present invention provides an electrical connector comprising:

an insulating body, a plurality of conducting terminals and a plurality of deformed terminals. The insulating body has a plurality of receiving notches, and the conducting terminals are received in the receiving notches respectively. Each conducting terminal includes a body and a contacting portion extending from the body. The deformed terminals are installed in the conducting terminals respectively. Each conducting terminal is connected to each deformed terminal for deforming the plastic of the conducting terminal.

Compared with the existing technology, the present electrical connector gives the conducting terminal an elastic nature and ensures that the electrical connection between the mating electrical components is more stable.

It is to be understood that both the foregoing general description and the following detailed description are exemplary. Other advantages and features of the invention will be apparent from the following description, drawings and claims.

BRIEF DESCRIPTION OF THE DRAWINGS

The above and further advantages of this invention may be better understood by referring to the following description, taken in conjunction with the accompanying drawings, in which.

Figure 1:
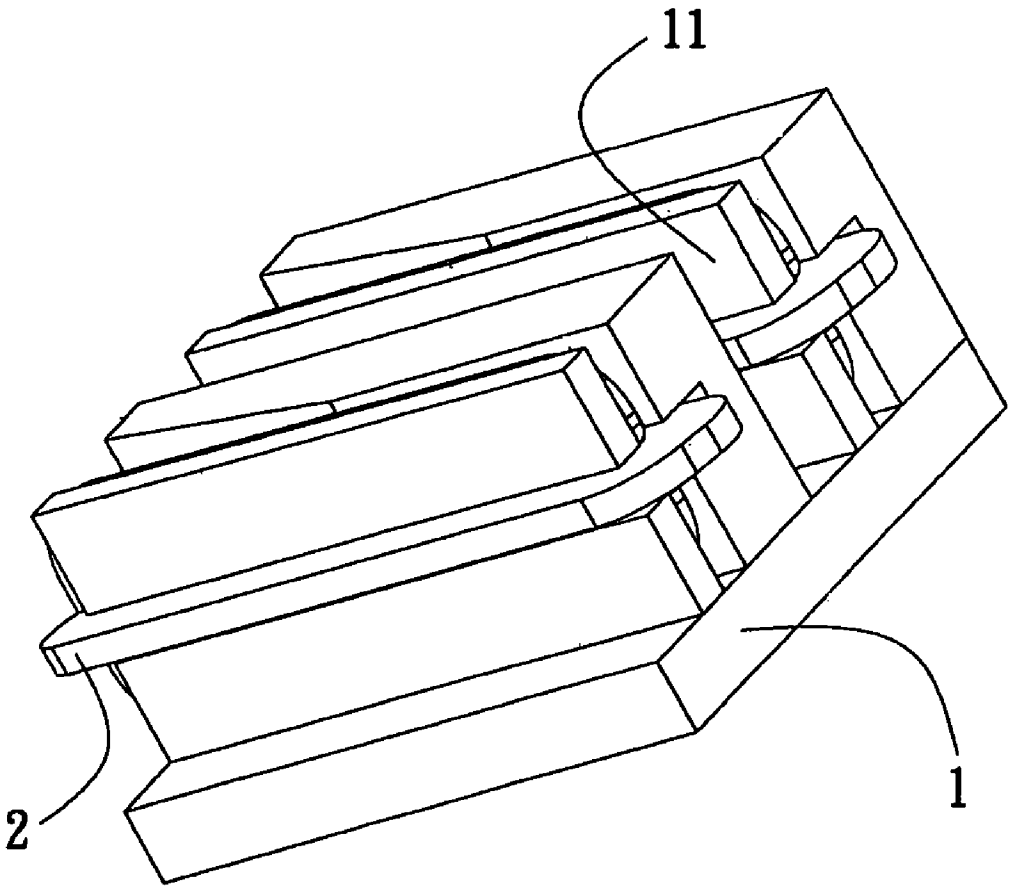
FIG. 1 is a partial perspective view of the first embodiment electrical connector of the present invention.
Figure 2:
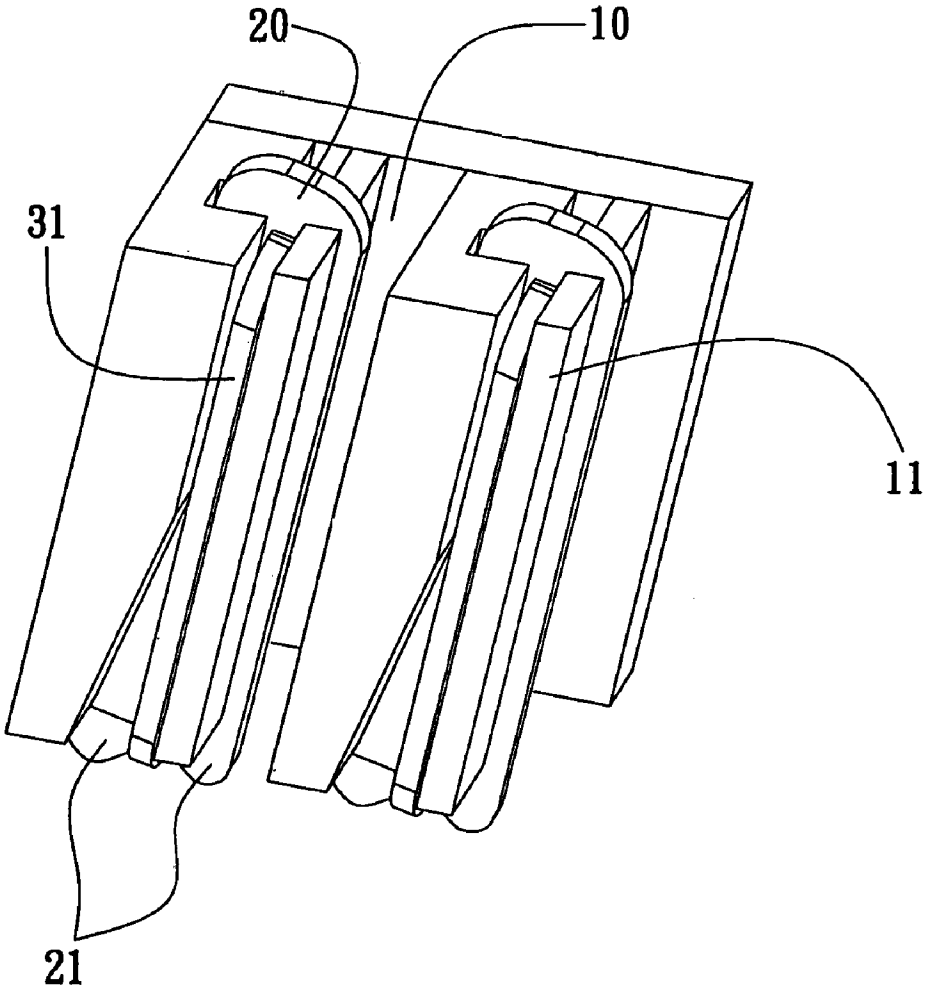
FIG. 2 is a partial perspective view of a point view of the electrical connector in FIG. 1.
Figure 3:
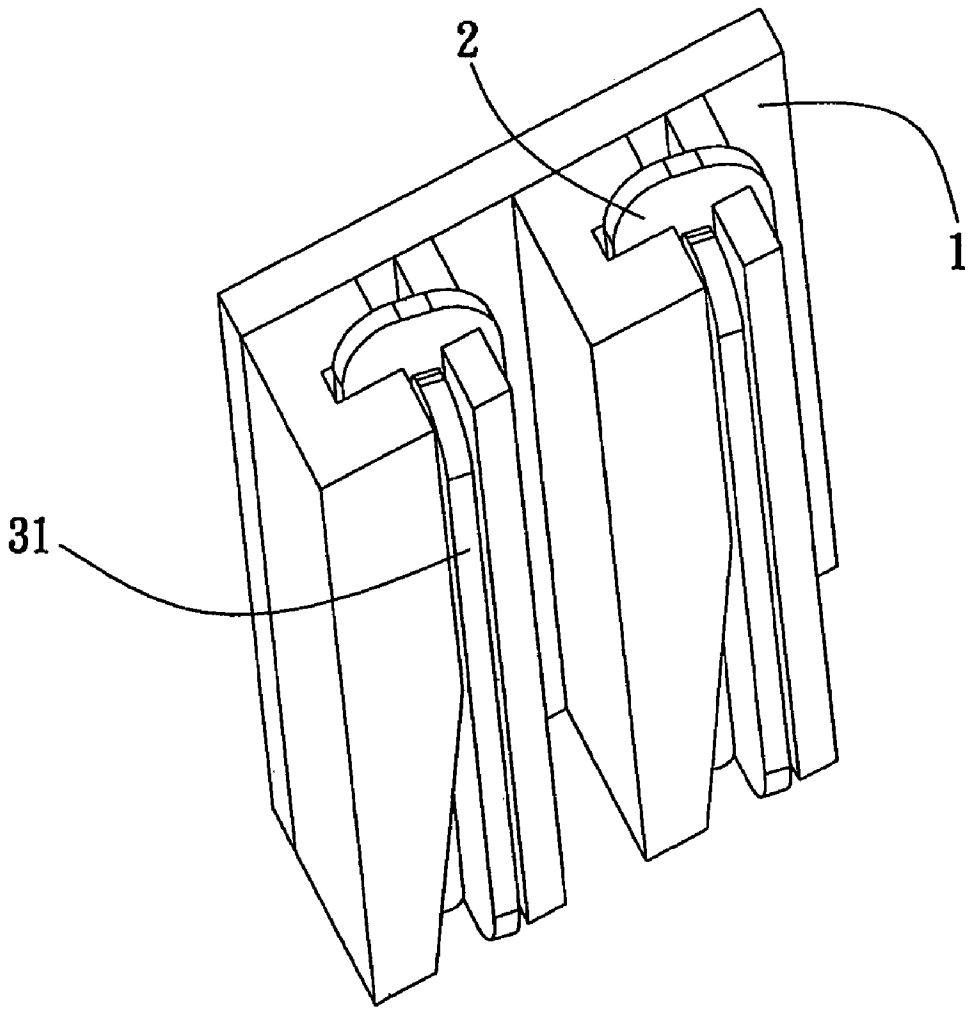
FIG. 3 is a partial perspective view of another point view of the electrical connector in FIG. 1.
Figure 4:
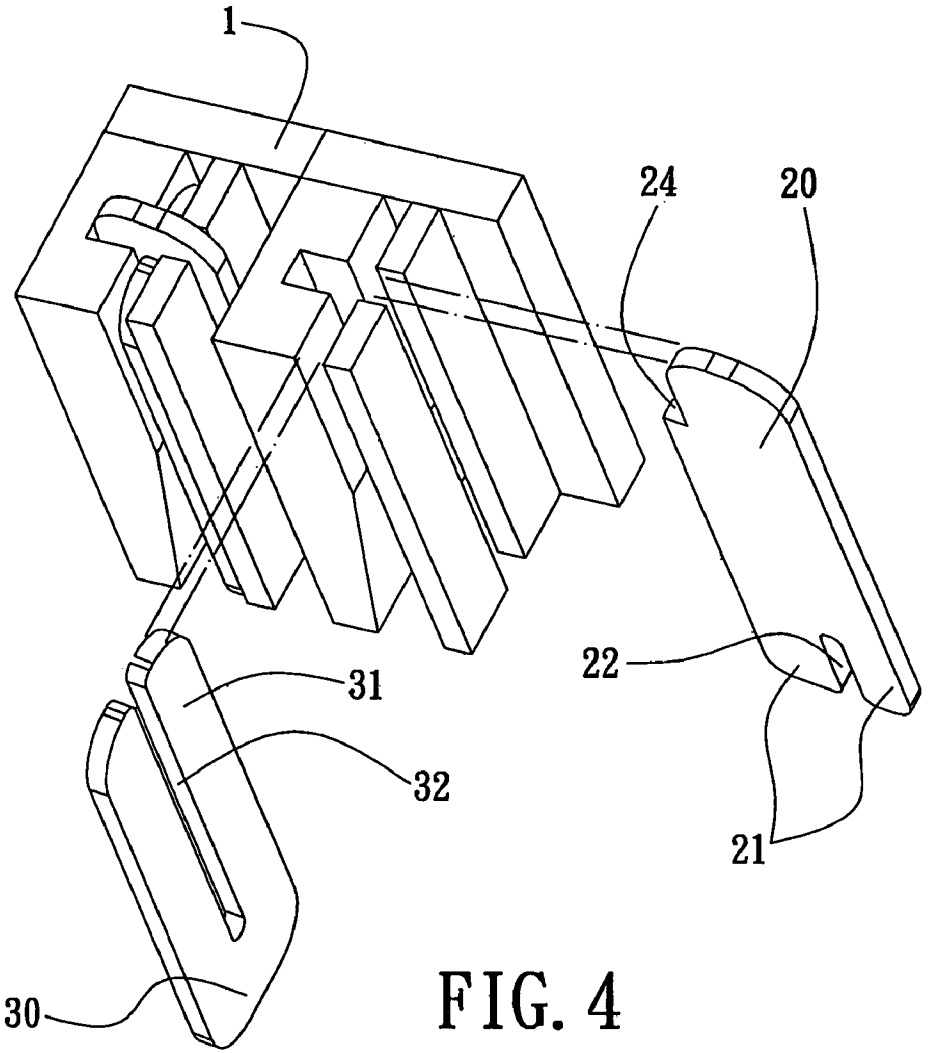
FIG. 4 is a partial and exploded perspective view of the electrical connector in FIG. 1.

The drawings will be described further in connection with the following detailed description of the preferred embodiments of the present invention.

DETAILED DESCRIPTION OF PREFERRED EMBODIMENTS

Please refer to FIGS. 1 to 4 which show the first embodiment of electrical connector of the present invention. The present invention is generally applied to an electrical connection between two mating electrical components (for connecting a planar lattice array chip module to a circuit board, or applied to other mating electrical components, such as an electrical connection between two circuit boards).

The electrical connector of the present invention comprises: an insulating body 1, a plurality of conducting terminals 2 and a plurality of deformed terminals 3 which are arranged on the conducting terminals 2 respectively, wherein the conducting terminals 2 cannot deform themselves, and each conducting terminal 2 connects to each deformed terminal 3 for deforming the plastic of the conducting terminals 2.

The insulating body 1 has a plurality of receiving notches 10. Each conducting terminal 2 and each deformed terminal 3 is respectively arranged and received in the receiving notches 10 of the insulating body 1. The insulating body 1 has a positioning portion 11 for orientating the deformed terminal 3.

Moreover, each conducting terminal 2 and each deformed terminal 3 are flake-shaped and they can be inserted in the receiving notches 10. Each conducting terminal 2 has a body 20, a contacting portion 21 which extends from the body 20, and a fixed portion 24 disposed within the insulating body 1 for holding the conducting terminals 2 within the insulating body 1. An end of the conducting terminal 2 is a two pointed-contacting terminal (alternatively both ends of the conducting terminal 2 are two pointed-contacting terminals). The body 20 of the conducting terminal 2 is fixed in the receiving notch 10 of the insulating body 1. The fixed portion 24 is correspondingly arranged in the matching portion (not shown) for fixing the conducting terminal 2 within the insulating body 1.

Each conducting terminal 2 and each deformed terminal 3 are cross-assembled. The length of the conducting terminal 2 is greater than the length of the deformed terminal 3. Each deformed terminal 3 includes a body portion 30 and an assembled portion 31 extending from the body portion 30. The assembled portion 31 can be arranged on the conducting terminal 2. The conducting terminal 2 further has a first trench 22 for holding the deformed terminal 2. The deformed terminal 3 has a second trench 32 which corresponds with the first trench 22 of the conducting terminal 2. The first trench 22 is arranged on one end of the contacting portion 21 of the conducting terminal 2, and the second trench 32 is arranged on one end of the assembled portion 31 of the deformed terminal 3. The conducting terminal 2 and the deformed terminal 3 can be connected stably through the first trench 22 and the second trench 32. The conducting terminal 2 can be deformed in such a way that it develops a better contact with the mating electrical component through the deformed terminal 3 when the mating electrical component connects to the conducting terminal 2. The conducting terminal 2 can return to its original shape through the elasticity of the deformed terminal 3, when the mating electrical component is disconnected.

Figure 5:
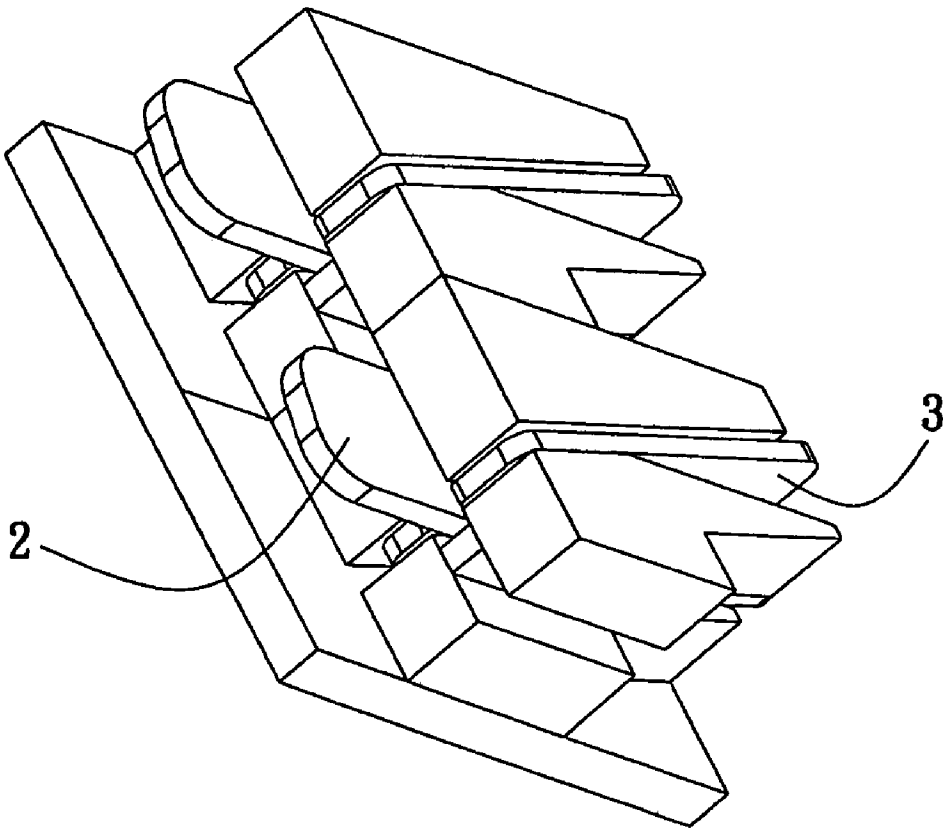
FIG. 5 is a partial perspective view of the second embodiment of electrical connector of the present invention.

Please refer to FIG. 5 which shows the second embodiment of the present invention. The difference between the first embodiment and the second embodiment is that in the second embodiment the deformed terminal 3 is obliquely disposed on the conducting terminal 2. The second embodiment achieves the same object as well as the first embodiment does.

According to the description above, the electrical connector of the present gives the conducting terminal an elastic nature and ensures the electrical connection between the mating electrical components is more stable through the deformed terminals which can be assembled in a crossed manner with the conducting terminals respectively.

Although the present invention has been described with reference to the preferred embodiments thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. An electrical connector, comprising:

an insulating body having a plurality of receiving notches;

a plurality of flake-shaped conducting terminals received in the receiving notches respectively, each conducting terminal having a body, said body having a first concave space defined in one end thereof and a pair of contacting portions extending from the body of said conducting terminals, whereby said contacting portions are separated by said concave space; and a plurality of flake-shaped deformed terminals, said deformed terminals each having a body portion, said body portion of said deformed terminals having a second concave space defined therein, whereby said second concave space of each of said deformed terminals is matingly received in each of said corresponding first concave space of said conducting terminals in a crossed manner;

whereby when said each conducting terminal matingly connects to each deformed terminal said contacting portions of said conducting terminal are resiliently adjustable to electrically contact with an external electrical component.

2. The electrical connector as claimed in claim 1, wherein the deformed terminals are obliquely disposed on the conducting terminals respectively.

3. The electrical connector as claimed in claim 1, wherein a length of the conducting, terminal is greater than a length of the deformed terminal.

4. The electrical connector as claimed in claim 1, wherein the deformed terminal includes a body portion and an assembled portion extending from the body portion.

5. The electrical connector as claimed in claim 1, wherein the conducting terminal further has a fixed portion held within the insulating body.

6. The electrical connector as claimed in claim 1, wherein the insulating body has a positioning portion for orientating the deformed terminal.

7. The electrical connector as claimed in claim 4, wherein the contacting portion has a first trench, and the assembled portion has a second trench cooperating with the first trench.

* * * * *